US006024530A

United States Patent [19]

Kleineisel et al.

[11] Patent Number: 6,024,530

[45] Date of Patent: Feb. 15, 2000

[54] SYSTEM FOR TRANSFERRING PLATE-LIKE OBJECTS FROM A FIRST POSITION TO A SECOND POSITION

[75] Inventors: Georg Kleineisel, Gemmingen; Friedrich Haller, Bietigheim-Bissingen, both of Germany

[73] Assignee: Schuler Automation GmbH & Co. KG, Hessdorf, Germany

[21] Appl. No.: 09/060,069

[22] Filed: Apr. 15, 1998

[30] Foreign Application Priority Data

Apr. 17, 1997 [DE] Germany ..... 197 16 039

[51] Int. Cl.[7] ..... B65G 63/00

[52] U.S. Cl. ..... 414/752; 414/797

[58] Field of Search ..... 414/749, 752, 414/797, 796.9; 212/312, 315, 319; 901/16, 21

[56] References Cited

U.S. PATENT DOCUMENTS

| | | | |
|---|---|---|---|
| 3,960,276 | 6/1976 | Gerhardt . | |
| 4,664,873 | 5/1987 | Hendrich et al. | 212/319 X |
| 4,971,515 | 11/1990 | Pol et al. | 414/797 |
| 5,012,665 | 5/1991 | Brandstetter . | |
| 5,718,550 | 2/1998 | Lanigan, Sr. et al. | 212/319 X |
| 5,738,487 | 4/1998 | Schaede | 901/16 X |

FOREIGN PATENT DOCUMENTS

| | | |
|---|---|---|
| 0691296 | 1/1996 | European Pat. Off. . |
| 2532919 | 3/1984 | France . |
| 2439032 | 8/1974 | Germany . |
| 2148230 | 5/1985 | United Kingdom . |

OTHER PUBLICATIONS

"CNC–gesteurte Transport–Einheit zur Automatisierung von Pressenlinien (CNC–Controled Transport–Unit for Automatization of line of Presses)," L. Schuler GmbH.

Abstract of DE 32 33 428 C1 from Derwent Information Ltd.

*Primary Examiner*—Donald W. Underwood

*Attorney, Agent, or Firm*—Browdy and Neimark

[57] ABSTRACT

An apparatus transfers plate-like parts, such as metal sheets, (2) from a stack to a forming station. A dual-rail stationary supporting structure (7) has tracks on which horizontal slides (15) move by means of outer cross slides **(8*a*, 8*b*) and inner cross slides (9*a*, 9*b*) on tracks (10–13) in the horizontal longitudinal direction. Each horizontal slide has a vertical slide (17) whose lower end is coupled to one end of a respective inner or outer transverse member (21, 22) which has holding elements, such as suction cups (25), on the bottom to hold the plates being moved. The lateral distance (a) between the vertical slides (17) of the outer pair of cross slides (8*a*, 8*b*) is larger than the lateral distance (b) between the vertical slides (17) of the inner pair of cross slides (9*a*, 9*b*). The two inner vertical slides (17) are located between the outer vertical slides (17). The vertical slides and the traverse members form a pair of U-shaped supporting structures. The inner supporting structure (24) can pass through the outer supporting structure (23)** so that the two move independently. While one carries a plate the other returns, empty, to the stack, doubling the transfer speed.

14 Claims, 3 Drawing Sheets

SYSTEM FOR TRANSFERRING PLATE-LIKE OBJECTS FROM A FIRST POSITION TO A SECOND POSITION

FIELD OF THE INVENTION

The present invention relates to a system for the individual transfer of plate-like parts from a first position into a second position. More particularly, the invention relates to such a system for transferring metallic plates from a stack of plates into a forming press; having a stationary supporting structure and a cross slide arranged on same, the latter containing a horizontal slide, which is slidable along the supporting structure in the horizontal longitudinal direction, on a track, and a vertical slide, which is movably guided on the horizontal slide in the vertical direction and connected to a holding device to hold each individual plate-type part.

REVIEW OF THE RELATED TECHNOLOGY

Systems of this type are used in many fields, for example in the auto industry, to feed sheet metal plates from a stack of plates to a press in which the plates are formed into a vehicle door or other automotive parts.

In industrial operations, the requirement of short handling times and maximum utilization of the machines is gaining increasing importance. It is in this context that the present invention has as its aim to create a system of the above type, with the aid of which the plate-like parts can be transferred in the shortest possible succession.

SUMMARY OF THE INVENTION

This aim is met according to the invention with the supporting structure having an outer pair and an inner pair of cross slides of the above type, whereby the two vertical slides of each pair of cross slides are located at a lateral distance from each other, with the lateral distance between the vertical slides of the outer pair of cross slides designed larger than the lateral distance between the vertical slides of the inner pair of cross slides, and with the two vertical slides of the inner pair of cross slides, as seen from the longitudinal direction, located between the two vertical slides of the outer pair of cross slides, and with the two vertical slides of each pair of cross slides connected to one another via a traverse member, said traverse member forming, together with at least one holding element connected to same, a holding device for a plate-like part, in a manner so that, as seen from the longitudinal direction, the two vertical slides of the outer pair of cross slides and the respective traverse member form an essentially U-shaped outer supporting structure, and the two vertical slides of the inner pair of cross slides and the respective traverse member form an essentially U-shaped inner supporting structure, each of which supporting structures can be moved separately in the vertical direction on the two horizontal slides of the respective assigned pair of cross slides, and in the horizontal longitudinal direction via the horizontal slides; and the inner supporting structure, if the height is adjusted appropriately, can move between the two supporting structures and through the outer supporting structure, so that the two supporting structures can simultaneously be moved in opposite directions along the horizontal longitudinal direction.

This means that during these movements in opposite directions, one of the two supporting structures is returning empty while the next plate-like part is already being transported forward by the other supporting structure, or by the holding device mounted on same, with the result that the cycle time is cut in half as compared to conventional systems with only one holding device, and twice as many parts can be fed to another machine located downstream within the same period of time.

A further advantage consists of the fact that the span of the traverse members in the lateral direction makes it possible to hold parts with an accordingly large surface. The system may be constructed with traverse members of virtually any random length, so that the system can also be adapted to plates with a width of several meters.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figure 4:
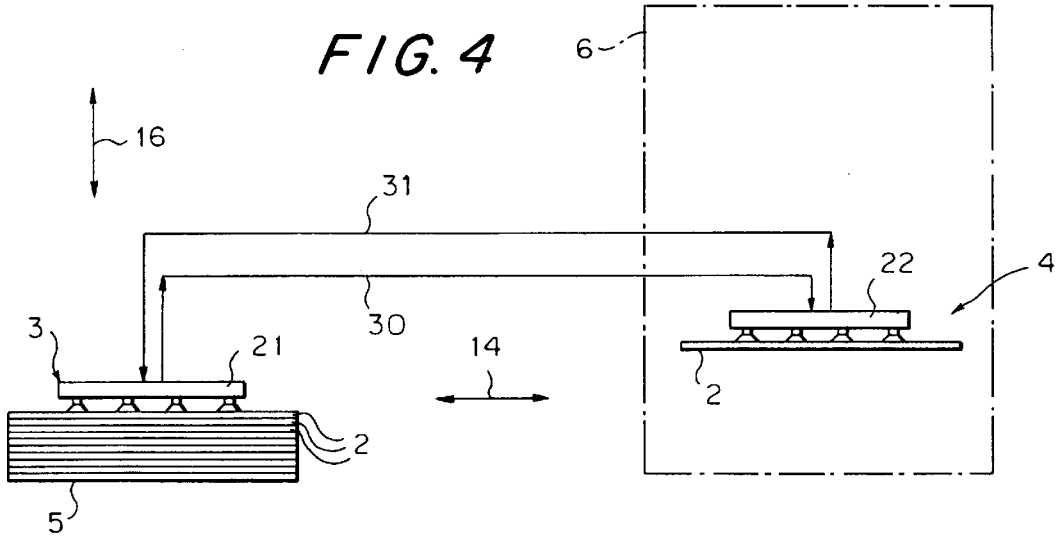
FIG. 4 is a schematic elevational side view illustrating the mode of operation of the system according to the invention.

FIG. 4 illustrates the transfer of plates from a stack of plates to a processing machine, such as a press, located downstream and marked in a dot-and-dash pattern. The system 1 illustrated in the drawing serves to transfer individual plate-like parts 2 from a first position 3 into a second position 4. As indicated in FIG. 4, the plate-like parts 2 are present in the first position 3 in stacked form, forming a plate stack 5. From here they may be transported individually to a machine, such as a press 6, located downstream in the second position 4. In the illustrated embodiment, the plate-like parts 2 consist of sheet metal plates that are formed into the respective part in the press 6.

Figure 1:
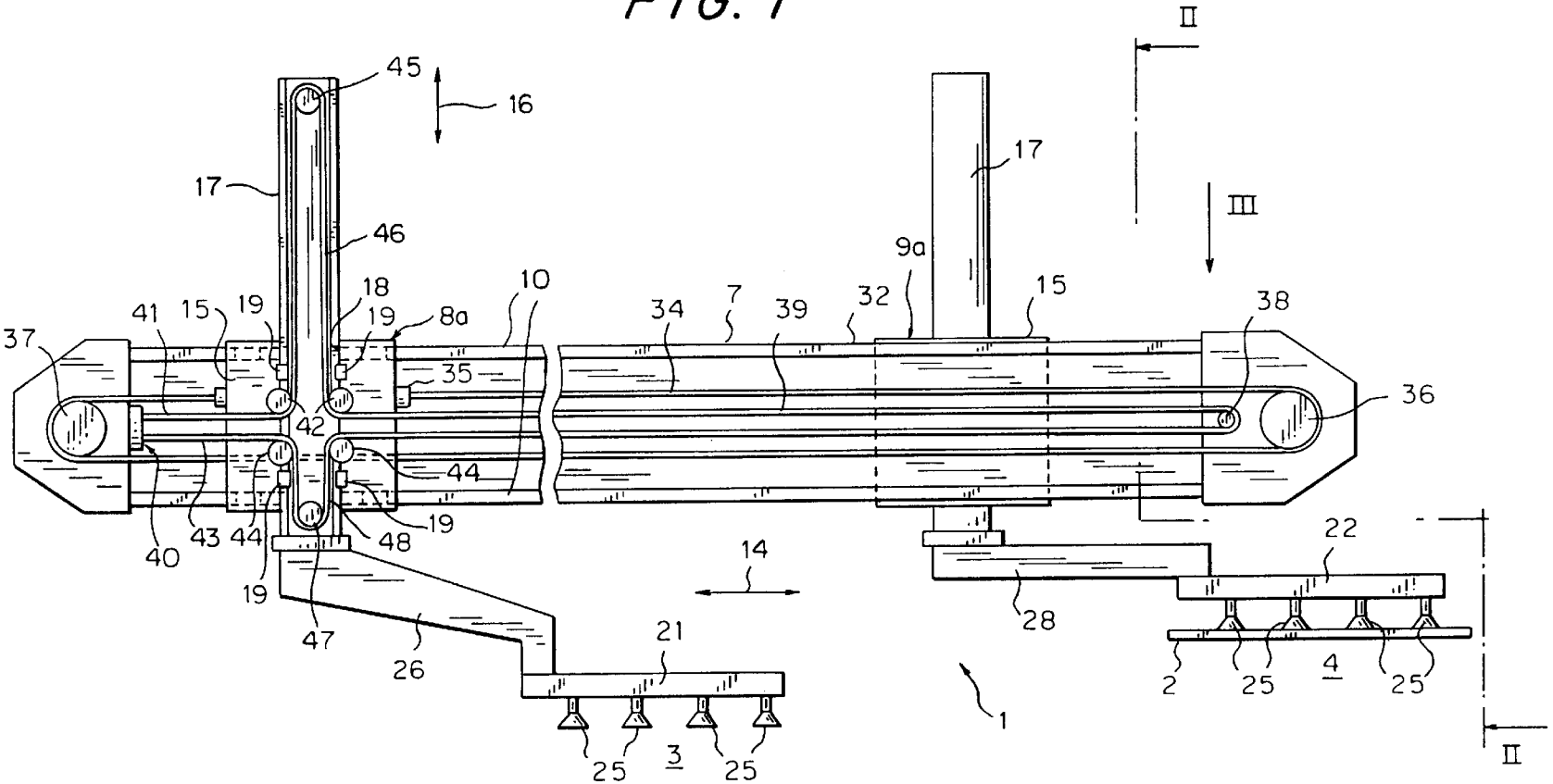
FIG. 1 is a schematic side view according to arrow I in FIG. 2 of a system according to the invention.
Figure 2:
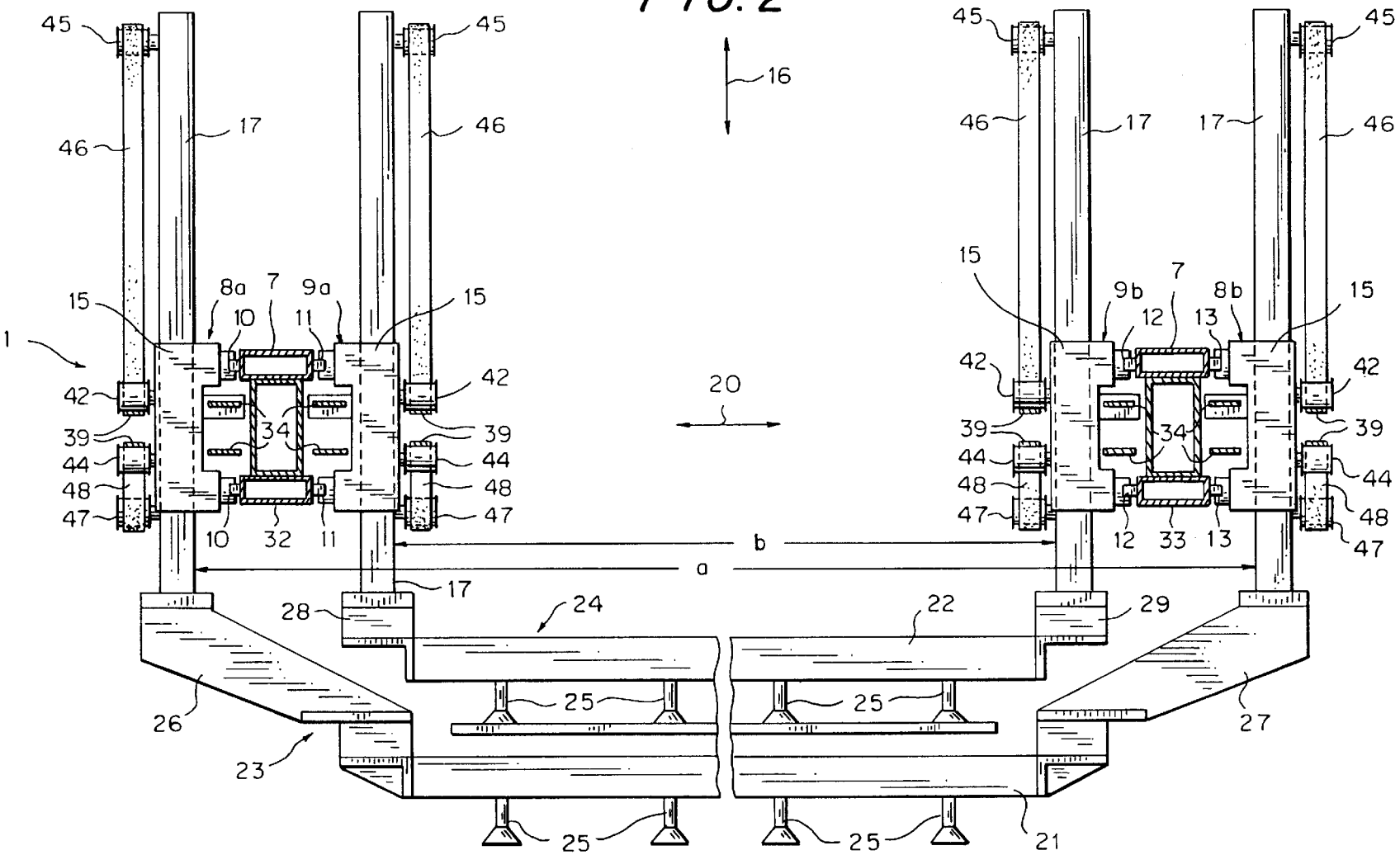
FIG. 2 is a cross sectional view along section lines II—II of FIG. 1.

Referring to FIGS. 1 and 2, the system 1 has a supporting structure 7, for stationary installation at the location of its use. Two cross slides 8*a*, 8*b*, forming an outer pair of cross slides, and two cross slides 9*a*, 9*b*, forming an inner pair of cross slides are movably guided on this supporting structure 7, allowing them to move in the horizontal longitudinal direction 14. Each cross slide is positioned on a track 10, 11, 12, and 13 of the supporting structure 7 extending in the horizontal longitudinal direction, along which track it can be moved back and forth. Each cross slide 8*a*, 8*b*, 9*a*, 9*b* has one horizontal slide 15 guided along the respective track 10, 11, 12 or 13, and a vertical slide 17, movably guided on the horizontal slide 15 in the vertical direction 16. The respective vertical slide 17 sits in a vertical cut-out 18 of the horizontal slide 15 extending in the vertical direction 16 and is movably guided in this cut-out 18 with the aid of guiding elements 19. In each cross slide 8*a*, 8*b*, 9*a*, 9*b*, the vertical slide 17 extends beyond the horizontal slide 15, both at the top and the bottom, and the upper and lower length of this projection changes as the horizontal slide is moved in the vertical direction 16. In the illustrated embodiment, the vertical slides 17 have a column-shaped longitudinal shape.

A projection, not shown in the drawing, can extend upward from the respective horizontal slide 15, parallel to the vertical slide 17, and a weight balancing device can be mounted to this projection, the other end of which is connected to the respective vertical slide 17 to compensate for the downward force of the weight of the vertical slide 17, with the result that the drive for the vertical slide 17 remains unburdened by the weight of the slide. This projection of the horizontal slide and the weight balancing system are not shown on the drawing.

In the lateral direction 20 perpendicular to the longitudinal direction 14 and to the vertical direction 16, the vertical slides 17 of the two outer cross slides 8*a*, 8*b* are installed at a lateral distance a, and the vertical slides 17 of the two inner cross slides 9*a*, 9*b* are installed at a lateral distance b. The lateral distance a between the vertical slides 17 of the outer pair of cross slides 8*a*, 8*b* is larger than the lateral distance b between the vertical slides 17 of the inner pair of cross slides 9*a*, 9*b*. As viewed from the longitudinal direction, the two vertical slides 17 of the inner pair of cross slides 9*a*, 9*b* are furthermore located between the two vertical slides 17 (FIG. 2) of the outer pair of cross slides 8*a*, 8*b*.

The two vertical slides 17 of each pair of cross slides 8*a*, 8*b*, and 9*a*, 9*b* are connected to one another via a traverse member 21 or 22, respectively, in a rigid connection. As viewed from the longitudinal direction 14, the two vertical slides 17 of the outer pair of cross slides 8*a*, 8*b*, and the respective traverse member 21 thus form an essentially U-shaped outer supporting structure 23, and the two vertical slides 17 of the inner pair of cross slides 9*a*, 9*b*, also form an essentially U-shaped inner supporting structure 24. The two supporting structures 23, 24, can each be moved in the vertical direction, along the two horizontal slides 15 of the respective assigned pair of cross slides 8*a*, 8*b* or 9*a*, 9*b*, and in the horizontal longitudinal direction 14 via said horizontal slides.

If the inner supporting structure 24 is moved up far enough so that its traverse member 22 is located above the traverse member 21 of the outer supporting structure 23, the inner supporting structure 24 fits through the outer supporting structure 23, as shown in FIG. 2. The two supporting structures 23, 24 can thus be moved along the supporting structure 7 in opposite directions, along the longitudinal direction 14, without getting in each others way.

The traverse members 21, 22, each have a plurality of holding elements 25, which, in the illustrated embodiments are designed in the form of suction devices. These holding elements 25 are located on the underside of the traverse members 21, 22. They serve to hold the plate-shaped parts 2, one at a time, by adhesion. When the traverse member 21 or 22 of one of the supporting structures is placed onto the uppermost part 2 of the plate stack 5 and the suction devices forming the holding elements 25 are connected to a vacuum source, the holding elements 25 adhere to the uppermost part 2 by suction, so that the part is removed from the stack 5 and can be transported into the second position 4.

Figure 5:
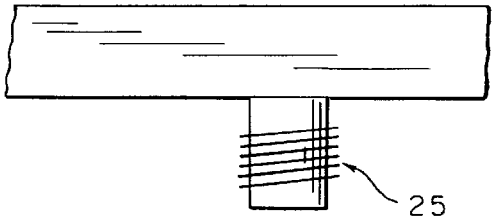
FIG. 5 is a schematic view of an electromagnetic holding element.

If the plates 2 are made of magnetizable metal, the holding elements 25 may be designed as magnetic elements in lieu of the suction devices. FIG. 5 shows an electromagnetic holding element 25. A permanent magnet can also be used.

In the second position 4, air is supplied to the suction devices to release the plate 2, or the current to the magnet elements is turned off, respectively.

The design of the individual holding elements 25 is not significant for the present context and they may be designed in virtually any form.

The respective traverse member 21 or 22, together with the respective holding elements 25, thus forms a holding device for each plate-like part 2 to be transported.

The arrangement of the horizontal slides 15 of the inner pair of cross slides 9*a*, 9*b* with respect to the horizontal slides 15 of the outer pair of cross slides 8*a*, 8*b* is, of course, also one in which the passage of the inner supporting structure 24 through the outer supporting structure 23 is not obstructed.

In the shown embodiment, the traverse member 21 or 22 of each supporting structure 23 or 24, as seen from the side (FIG. 1), is located in front of the plane formed by the two vertical slides 17 of the supporting structure 23 or 24, respectively. As viewed from the side, the arrangement is one of an L-shape. This allows the traverse members 21, 22 to be moved into the press 6 to set down each plate-like part 2.

In the shown embodiment, the traverse member 21 of the outer supporting structure 23 is connected to the two respective vertical slides 17 via lateral connection arms 26, 27, and the traverse member 22 of the inner supporting structure 24 is connected to the two respective vertical slides 17 via lateral connection arms 28, 29.

In the position shown in the drawing, particularly in FIG. 4, the traverse member 21 of the outer supporting structure 23 lifts a plate 2 off the stack 5 in the first position 3 with the aid of the holding elements 25, while the traverse member 22 deposits inside the press 6 the plate element 2 previously removed from the stack 5 and transported to the press 6. Subsequent to this situation, the traverse member 21 with the attached plate 2 moves along the movement path 30 to the press 6, while the traverse member 22 without a plate is moved back to the plate stack 5 along the movement path 31 in the opposite direction. As shown by the arrows in FIG. 4, the two movement paths 30, 31 comprise both vertical as well as horizontal components.

A practical supporting structure 7 will contain two parallel longitudinal supports 32, 33 at a lateral distance from each other, with one horizontal slide 15 of the outer pair of cross slides 8*a*, 8*b* and one horizontal slide of the inner pair of cross slides 9*a*, 9*b* guided along each of the parallel longitudinal supports. The two cross slides 8*a*, 8*b* of the outer pair of cross slides are guided along the outer sides of the two longitudinal supports 32, 33 facing away from each other, while the two cross slides 9*a*, 9*b* of the inner pair of cross slides are guided along the insides of the two longitudinal supports facing each other.

The horizontal slide 15 and the vertical slide 17 of each cross slide 8*a*, 8*b*, 9*a*, 9*b*, are driven according to the same method, by means of an assigned belt drive. Since the drive characteristics are the same for all cross slides, the description of the drive for the horizontal slide 15 and for the vertical slide 17 of the cross slide 8*a* shown in FIG. 1 will suffice:

The horizontal slide 15 has an assigned drive belt 34, whose one end 35 is attached to the side of the horizontal slide 15, from where it extends along the supporting structure 7 to a drive wheel 36 installed on one longitudinal end of the supporting structure 7, where the drive belt is led around this drive wheel 36 and then extends back along the supporting structure 7 to its other longitudinal end where the drive belt is led around a deflection roller 37 and then extends to the other side of the horizontal slide 15 where it is connected to same. If the drive wheel 36 is driven in one or the other turning direction, the horizontal slide 15 in FIG. 1 moves to the left or right in the longitudinal direction 14.

The vertical slide 17 of the cross slide 8*a* also has an assigned belt drive with a drive belt 39 led around a drive wheel 38. The two ends of this drive belt 39 are fastened at the same end of the supporting structure, at the location of the arrow 40. The drive wheel 38 is located at the opposite end of the supporting structure 7, which, in the shown example, is the same end at which the drive wheel 36 is located for the drive belt assigned to the horizontal slide 35. The horizontal slide 15 has two deflection rollers 42 assigned to the upper strand of the drive belt 39 and two deflection rollers 44 assigned to the lower strand 43 of the drive belt 39, with the upper strand 41 forming a belt loop 46 extending between the two deflection rollers 42 upward along the vertical slide 17 and around an upper deflection roller 45 mounted on the vertical slide, and the lower strand 43 forming a belt loop 48 extending between the two deflection rollers 44 downward along the vertical slide 17 and around a deflection roller 47 mounted on the vertical slide 17. If the drive wheel 38 is driven in one or the other direction, the vertical slide shifts in the vertical direction and changes the length of the two belt loops 46, 48.

Figure 3:
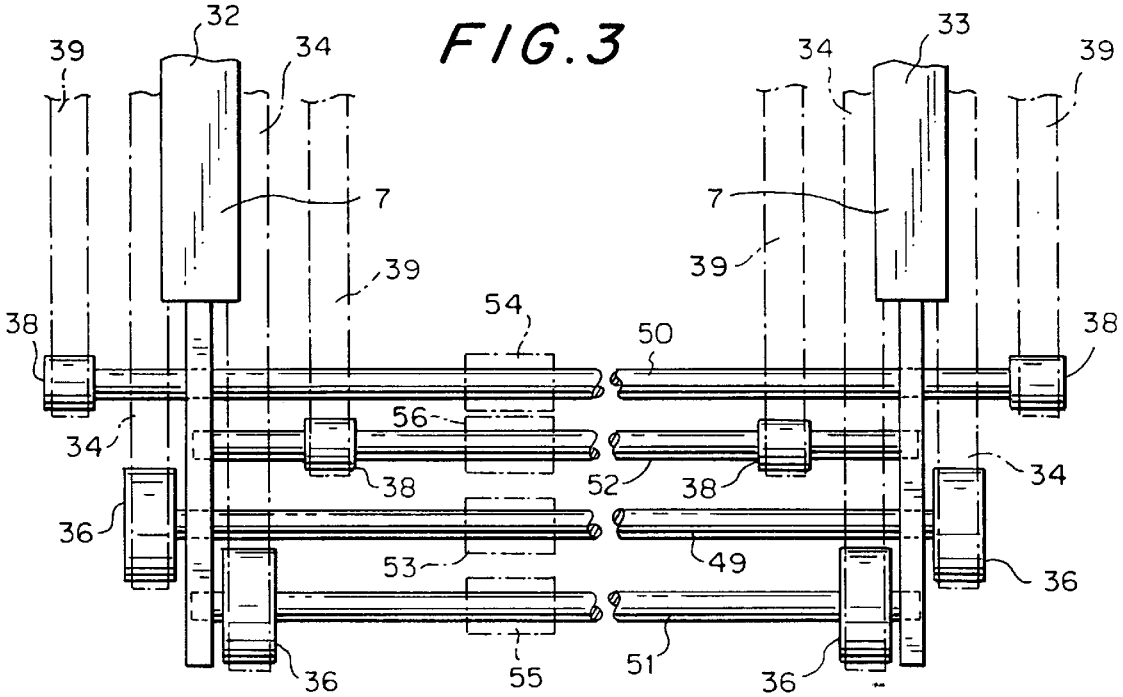
FIG. 3 is a top plan view according to arrow III in FIG. 1, showing the end section of the supporting structure shown on the right in FIG. 1.

As mentioned above, each cross slide 8*a*, 8*b*, 9*a*, 9*b* has a belt drive of this type assigned to its horizontal slide 15 and vertical slide 17, so that, for reasons of simplicity, the same reference numerals used in FIG. 2 and 3 for the cross slide 8*a* were also used for the other belt drives.

The drives for the different slides could, of course, also be implemented according to a different system. The described method, however, is relatively easy to implement.

As shown in the drawing, specifically in FIG. 3, the drive wheels 36 of the horizontal slide 15 of the two outer cross slides 8*a*, 8*b* may furthermore be connected to one another via a spacer shaft 49; the drive wheels 38 of the vertical slides 17 of the two outer cross slides 8*a*, 8*b* via a spacer shaft 50; the drive wheels 36 of the horizontal slides of the two inner cross slides 9*a*, 9*b* via a spacer shaft 51; and the drive wheels 38 of the vertical slides 17 of the two inner cross slides 9*a*, 9*b* via a spacer shaft 52, so that a synchronous drive results on both sides.

In principle, the two wheels could also each be assigned a separate single drive in lieu of the spacer shafts, and the two individual drives could specifically be electrically synchronized.

FIG. 3 furthermore shows in a dot-and-dash pattern that the motorized drive devices 53, 54, 55, 56 assigned to the slides may have a drive connection to the spacer shafts 49, 50, 51, 52.

It should also be added that the traverse members 21, 22, do not have to be rigidly connected to the vertical slide 17 but may instead be rendered exchangeable, so that they can be adapted to the respective application.

The traverse members 21, 22, furthermore do not need to project to the front of the plane formed by the vertical slides 17 but, depending on the application, may also be located in this plane below the vertical slide.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. An apparatus for transfer of plate-like objects from a first position to a second position, comprising:

(A) a supporting stationary structure (7);

(B) an essentially U-shaped inner supporting structure (24) comprising:

an inner holding device including an inner transverse member (22) wherein at least one of the plate-like objects is holdable by the inner holding device, inner horizontal slides (15) movable on the stationary structure in a horizontal longitudinal direction, and inner vertical slides (17) connected to the inner transverse member and movable in a vertical direction on the inner horizontal slides (15); and (C) an essentially U-shaped outer supporting structure (23) comprising:

an outer holding device including an outer transverse member (21) wherein at least one of the plate-like objects is holdable by the outer holding device, outer horizontal slides (15) movable on the stationary structure in the horizontal longitudinal direction, and outer vertical slides (17) connected to the outer transverse member and movable in the vertical direction on the outer horizontal slides (15);

(D) wherein a first lateral distance (a) between the outer vertical slides is larger than a second lateral distance (b) between the inner vertical slides, whereby the inner vertical slides (17) are located, as viewed along the horizontal longitudinal direction, between the outer vertical slides (17);

whereby the inner supporting structure (24) and the outer supporting structure (23) are independently movable both horizontally and vertically and are simultaneously movable in opposite directions along the horizontal longitudinal direction.

2. The apparatus according to claim 1, wherein the plate-like objects include metallic plates, the first position comprises a stack of the metallic plates, and the second position comprises a forming press for processing the metallic plates.

3. The apparatus according to claim 1, wherein the inner holding device comprises at least one holding element (25).

4. The apparatus according to claim 1, wherein the outer holding device comprises at least one holding element (25).

5. The apparatus according to claim 1, wherein each inner horizontal slide (15) comprises an inner cross slide (9*a*, 9*b*) movable on inner tracks (11, 12) of the stationary structure (7) in the horizontal longitudinal direction, and each outer horizontal slide (15) comprises an outer cross slide (8*a*, 8*b*) movable on outer tracks (10, 13) of the stationary structure (7) in the horizontal longitudinal direction.

6. The apparatus according to claim 5, comprising a pair of inner cross slides and a pair of outer cross slides.

7. The apparatus according to claim 6, wherein the supporting structure (7) includes two parallel longitudinal beams (32, 33) set at a third lateral distance from each other, and wherein one of the outer pair of cross slides (8*a*, 8*b*) is guided along each of the two parallel longitudinal beams, and one of the inner pair of cross slides (9*a*, 9*b*) is guided along each of the two parallel longitudinal beams.

8. The apparatus according to claim 7, wherein the two cross slides (8*a*, 8*b*) of the outer pair of cross slides are guided along outer sides of the two longitudinal beams (32, 33), the outer sides facing away from each other.

9. The apparatus according to claim 7, wherein the two cross slides (9*a*, 9*b*) of the inner pair of cross slides are guided along insides of the two longitudinal beams (32, 33), the insides facing one another.

10. The apparatus according to claim 1, wherein each horizontal slide (15) and each vertical slide (17) of the inner and outer supporting structures are moved by a driving belt (34, 39) and a drive wheel (36, 38).

11. The apparatus according to claim 10, wherein the drive wheels (36, 38) of the belt drives for the two horizontal slides (15) and for the two vertical slides (17) of each pair of cross slides (8*a*, 8*b* or 9*a*, 9*b*) are connected to one another via a spacer shaft (49, 50, 51, 52).

12. The apparatus according claim 1, including a plurality of holding elements (25) connected to each transverse member and comprising respective suction elements to adhere the respective plate-like part (2) thereto.

13. The apparatus according claim 1, including a plurality of holding elements (25) connected to each transverse member and comprising respective magnets to adhere the respective plate-like part (2) thereto.

14. The apparatus according to claim 1, wherein the inner transverse member (22) is offset, in the horizontal longitudinal direction, from a plane formed by two of the inner vertical slides (17), and wherein the outer transverse member (21) is offset, in the horizontal longitudinal direction, from a plane formed by two of the outer vertical slides (17).

* * * * *